United States Patent [19]

Bishop et al.

[11] Patent Number: 4,470,428

[45] Date of Patent: Sep. 11, 1984

[54] UNLOADER AND CHECK VALVE

[75] Inventors: William V. Bishop; Lawrence Schlesinger, both of Durham, N.C.

[73] Assignee: Eaton Corporation, Cleveland, Ohio

[21] Appl. No.: 380,588

[22] Filed: May 21, 1982

[51] Int. Cl.[3] ..... F04B 49/08

[52] U.S. Cl. ..... 137/116; 137/512.2; 417/299

[58] Field of Search ..... 137/116, 512.2; 417/299

[56] References Cited

U.S. PATENT DOCUMENTS

| | | | |
|---|---|---|---|
| 2,820,673 | 1/1958 | Zubaty | 137/116 X |
| 3,358,705 | 12/1967 | Krechel | 137/116 |
| 3,967,635 | 7/1976 | Sealfon | 137/512.2 X |
| 4,237,918 | 12/1980 | German | 137/116 |
| 4,321,940 | 3/1982 | Krechel | 137/116 |

*Primary Examiner*—Robert G. Nilson

*Attorney, Agent, or Firm*—F. M. Sajovec; C. H. Grace

[57] ABSTRACT

A combined unloading valve and check valve (10) for use with a motor driven air compressor. The unloading valve (16) includes a spool (30) axially movable within a tubular body (12). In the unloading position of the valve, one of two spaced-apart ring seals (32) on the spool is out of engagement with the body to open a flowpath from the inlet of the valve past the spool to exhaust ports (28) formed in the body. When the compressor is operating and the valve is pressurized, both ring seals engage the body to close off the flowpath. The check valve (18) extends beyond the end of the body and includes a poppet valve element (50) which engages a valve seat (52) formed on an end of the spool. When the unloading valve and check valve is installed in a wall (14) of an air tank the check valve extends into the air supply within the tank, thereby helping to cool the internal elements of the valve structure.

10 Claims, 2 Drawing Figures

UNLOADER AND CHECK VALVE

Figure 2:
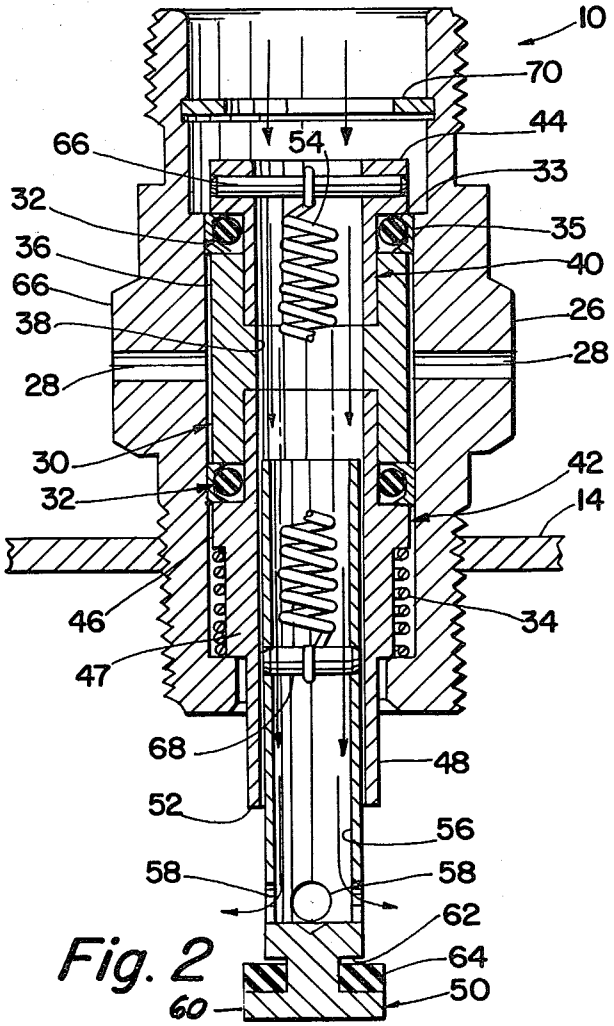

The present invention relates to unloaders for air compressors, and particularly to a combined unloader and check valve for use with a motor driven air compressor.

When an air compressor is shut down the compressor head will remain pressurized unless the pressure is relieved by some means. In a motor driven compressor, if this pressure is not relieved or bled off before the compressor is restarted, the motor will tend to stall.

It is known to provide an unloading device which relieves the head pressure when the compressor is turned off such that when the compressor is restarted a relatively small load is imposed on the motor until the motor gets up to operating speed. Such known devices, however, generally include open bleed passages which tend to bleed excessive air when the compressor is operating, or which are likely to become clogged and inoperative. Also, if the compressor is a piston type, such known unloading devices tend to exhaust to atmosphere upon completion of each pressure pulse by the compressor.

Another problem associated with known unloaders is that of carbon buildup within the valve structure. More specifically, such unloaders tend to get very hot when the compressor is operating. As a result, carbon tends to build up on the interior components of the valve, which buildup can be severe enough to cause the unloader to stop functioning.

It is an object of the present invention to provide an unloading device for an air compressor which is simple and reliable, and which can be produced at a reasonable cost.

Another object of the invention is to provide an unloading valve having bleeding means which will not tend to become clogged, and in which the bleed rate is controlled to function efficiently to relieve compressor head pressure when the compressor is shut down without bleeding off an excessive amount of pressurized air when the compressor is operating.

Another object of the invention is to provide an unloading valve which will not exhaust to atmosphere at the completion of every pressure pulse during normal operation of a piston-type compressor.

Another object of the invention is to provide a combined unloading valve and check valve in which the buildup of carbon on the internal components thereof is minimized.

To meet the above objectives, the present invention provides an unloader in which the unloading ports are closed completely during operation of the compressor and in which the check valve element is located such that the unloader remains relatively cool during operation of the compressor. More specifically, the invention provides an unloader comprising a tubular body screwed into the wall of an air tank, in which the unloading element is in the form of an annular spool which includes sealing rings at opposite ends thereof. In the unloading mode air passes along a clearance space between the spool and the body and exhausts through ports in the body wall. In the operating mode the spool is positioned so that the sealing rings block the flow path to the exhaust ports. The check valve element is a poppet valve received within the unloading spool and in which the valve element thereof extends well into the air tank while the compressor is operating, thus providing effective cooling of the internal valve components.

Figure 1:
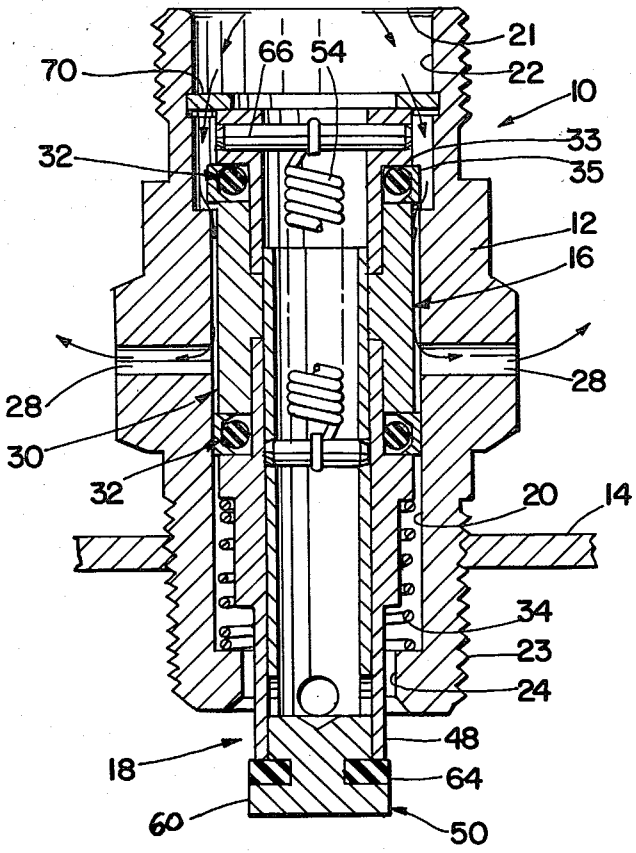

Other objectives and advantages of the invention will be apparent from the following description when considered in connection with the accompanying drawing, wherein:

FIG. 1 is a cross-sectional view of the invention in its unloading position, and FIG. 2 is a view similar to FIG. 1 but showing the invention in its operating position.

Referring to the drawing, there is illustrated a combined unloading valve and check valve 10 comprising a tubular body 12 threaded into a wall 14 of an air tank or accumulator, an annular unloading valve assembly 16 received within the body 12, and a check valve assembly 18 received within the unloading valve assembly.

The valve body 12 is a tubular member having a main bore 20, an enlarged counterbore 22 formed at one end 21 thereof, and a smaller bore 24 formed at the opposite end 23 thereof. The counterbored end 21 has an external thread formed thereon for connection to a high-pressure outlet line from a compressor, and the opposite end 23 has an external thread formed thereon for connection to the tank wall 14. To facilitate connection to the air line and tank, wrench flats 26 are formed centrally of the body 12. A plurality of exhaust ports 28 are formed through the walls of body 12 and open into the main bore 20 for a purpose to be discussed in more detail later in this description.

The unloading valve assembly 16 comprises a tubular spool assembly 30 received for axial movement within the main bore 20, a pair of spaced-apart ring seals 32 received in annular grooves formed in the spool assembly, and a compression spring 34 acting between the spool assembly and a shoulder defined by the intersection of the main bore 20 with the bore 24 to bias the spool assembly to the unloading position shown in FIG. 1.

In the preferred embodiment illustrated, the spool assembly 30 comprises three interfitting members, including a central member 36 having a main bore 38 and opposed counterbores, a first end member 40 received in one counterbore and being stopped against a shoulder defined by the intersection of the main bore 38 and the counterbore, and a second end member 42 received in the other counterbore and stopped against a shoulder defined by the intersection of the main bore 38 and the corresponding counterbore. It will be appreciated, however, that spool assembly 30 can be formed of a single piece of material.

The first end member 40 is formed with an outer head portion 44 which, when the end member is bottomed within its counterbore, is spced from the central member to define an annular groove between the head portion and the central member to receive one of the ring seals 32.

The second end member 42 also includes an outer head portion 46 which is also located to define, along with the central member 36, an annular groove receiving the second ring seal 32. The head portion 46 is elongated and includes an intermediate portion 47 of smaller diameter which serves as a guide for the compression spring 34, with a shoulder defined by the upper end of the intermediate portion serving as a stop for the spring. The second end member also includes a tubular extended portion 48 which forms part of the check valve assembly 18 as will be described in more detail later in this description.

The end members 40 and 42 each have a bore formed therethrough which is the same diameter as the main bore 38 of the central member 36 to define a uniform through bore in which the check valve assembly is received. To retain the central member 36 and the end members 40 and 42 is assembled position in relation to the seals 32, the end members can be press fit into their respective counterbores.

In the preferred embodiment illustrated the ring seals 32 are of a commercially available type which includes an inner O-ring portion 33 and an outer ring 35 of a low-friction material such as Teflon. While this construction is preferred, the invention can also be expected to function effectively using conventional O-rings as the seals 32, in which case the spool assembly 30 can be formed as a single piece in place of the three-piece structure illustrated herein.

The check valve assembly 18 comprises a cylindrical valve element 50, a valve seat 52 defined by the end of the extended portion 48 of the end member 42, and an extension spring 54, which acts between the unloading valve assembly 16 and the valve element to bias the valve element to the position shown in FIG. 1.

The valve element 50 has a blind bore 56 formed therein which is intersected by a plurality of cross ports 58 adjacent the bottom of the bore. A head 60 is formed at the end of the valve element and an annular groove 62 is formed in the solid portion of the valve element between the bottom of the bore 56 and the head 60 to retain an elastomeric seal element 64 which engages the valve seat 52 when the unloader is in the FIG. 1 position.

The extension spring 54 is fixed to the unloading valve assembly by means of a pin 66 received through a hooked end portion of the spring and pressed into a cross hole formed in the head portion 44 of the first end member 40. The opposite end of the spring is similarly fixed to valve element 50 by means of a pin 68 received through a cross hole formed in the valve element.

When the unloader and check valve 10 is assembled the subassembly including the unloading valve assembly 16 and the check valve assembly 18 is inserted into the body 12 and the spring 34 is compressed to at least the position shown in FIG. 1, after which a retaining ring 70 is inserted into a groove formed in the counterbore 22 to retain the subassembly within the body.

OPERATION

The unloader and check valve of the invention are particularly adapted for use with the inlet end 21 connected to the outlet of an air compressor, and the outlet end 23 threaded into a wall 14 of an air tank or accumulator.

When the inlet end 21 of the valve 10 is not pressurized the valve will be in the position shown in FIG. 1 with the unloading valve assembly 16 biased upward against the retaining ring 70 by the compression spring 34 and the seal element 64 of the valve element 50 biased into sealing engagement with the seat surface 52 by the extension spring 54. In this position of the device no air will escape from the tank 14 since the flow path from the tank to the exhaust ports 28 along the spool assembly 30 is closed by the lower one of the ring seals 32, and the flow path through the check valve 18 is closed by the contact of the valve element 64 with the seat surface 52.

A flow path is maintained, however, from the inlet end 21 to the exhaust ports 28. As shown in FIG. 1, in this position of the unit the upper of the ring seals 32 is out of engagement with the main bore 20 and as indicated by the arrows, air can flow from the inlet end, between the spool assembly 30 and the main bore 20 and out the ports 28. This flow path insures that when a compressor to which the unit is connected is shut down the pressure remaining within the head of the compressor will be relieved so that the compressor motor will not stall when it is restarted.

When the compressor is restarted, air pressure acting on the upper end of the spool assembly will move the spool assembly downward against the force of spring 34 to the position shown in FIG. 2. In this position, upper ring seal 32 engages the bore 20 to prevent leakage from the inlet end of the unit through the ports 28. At the same time, air pressure acting on the valve element 50 will move it to the FIG. 2 position against the force of spring 54. In this position, the seal element 64 is lifted off the seat surface 52 and the valve element 50 extends into the tank 14 to open a flow path from the inlet end 21 to the ports 58 as shown by the arrows. Since the valve element 50 extends well into the interior of the tank, the air within the tank will tend to cool the valve element, thus reducing the tendency for carbon to build up on the internal elements of the unit when the compressor is operating.

We claim:

1. In a valve comprising a tubular body having an inlet end, an outlet end and a bore formed therein from said inlet end; check valve means received within said body and movable between an open position when flow is from said inlet end toward said outlet end and a closed position when flow is from said outlet end toward said inlet end; an inlet passage formed in said inlet end in communication with said bore; and unloading valve means received in said body and communicating with said inlet passage, said unloading valve means being movable between a first position opening a flow path from said inlet passage to atmosphere when said inlet passage is pressurized less than a predetermined value and a second position stopping flow therethrough when said inlet passage is pressurized to at least said predetermined value: the improvement wherein said check valve means comprises a first valve element having a valve seat formed thereon extending beyond the outlet end of said body, and a second valve element having a seal element thereon engageable with said valve seat, said second valve element extending outward of said first valve element; and said unloading valve means comprises a cylindrical spool received in said bore, first and second spaced-apart seals acting between said spool and said bore, said spool being movable between a first position wherein one of said seals is disposed within said inlet passage out of engagement with said bore and a second position wherein both of said seals are in engagement with said bore, means biasing said spool into said first position, one or more exhaust ports formed in said body, and means defining a flow path from said inlet passage to said one or more exhaust ports, said flow path being open when said spool is in said first position and closed when said spool is in said second position.

2. Apparatus as claimed in claim 1 in which said first valve element is defined by a portion of said unloading valve means, said portion extending beyond the outlet end of said body a first distance when said unloading valve means is in its first position and a second distance greater than the first when said unloading valve means is in its second position.

3. Apparatus as claimed in claim 1, in which said means biasing said spool comprises a compression spring acting between said spool and said body.

4. Apparatus as claimed in claim 1 in which said first and second spaced-apart seals include O-rings received in grooves formed in said spool.

5. Apparatus as claimed in claim 1 in which said spool has a through bore formed therein, one end of said through bore opening into said inlet passage and the opposite end defining an outlet passage of said valve; and said check valve means comprises a valve seat defined by an end of said spool, and a valve element received within said through bore and having a seal element formed thereon engageable with said valve seat, said valve element being movable between a first position wherein said seal element is engaged with said seat to prevent flow from said inlet passage to said outlet passage when said inlet passage is at a pressure below a predetermined minimum and a second position wherein said seal element is out of engagement with said seat to permit flow from said inlet passage to said outlet passage when said inlet passage is at a pressure at or above said predetermined minimum.

6. Apparatus as claimed in claim 5, in which said valve element comprises a tube received within the through bore of said spool, said tube having an axial blind bore formed therein, and one or more radial ports formed in the wall of said tube intersecting said blind bore, and said seal element comprises an elastomeric member received on the closed end of said tube.

7. Apparatus as claimed in claim 6, including an extension spring received within said tube and acting between said spool and said tube to bias said tube to a position wherein said elastomeric member is in engagement with said valve seat.

8. Apparatus as claimed in claim 5, including a first pin received radially through said spool, and a second pin received radially through said tube, the ends of said extension spring being attached to said first and second pins.

9. Apparatus as claimed in claims 1 or 2, in combination with a tank, the outlet end of said body being received within a hole formed in a wall of said tank whereby said check valve extends into the interior of said tank.

10. Apparatus as claimed in claim 9, in which said exhaust ports are disposed outside said tank.

* * * * *